US005855749A

United States Patent [19]

Kohut et al.

[11] Patent Number: 5,855,749

[45] Date of Patent: Jan. 5, 1999

[54] VENTILATION SYSTEM FOR ELECTROLYTIC CELL

[75] Inventors: Stephen J. Kohut, Chandler, Ariz.; James A. Murray, Walnut Creek; Jonathan M. Berkoe, San Rafael, both of Calif.

[73] Assignee: ElectroCopper Products Limited, Mesa, Ariz.

[21] Appl. No.: 865,134

[22] Filed: May 29, 1997

[51] Int. Cl.[6] ..... C25D 17/02; C25D 21/04

[52] U.S. Cl. ..... 204/270; 204/277; 204/278

[58] Field of Search ..... 204/270, 277, 204/278

[56] References Cited

U.S. PATENT DOCUMENTS

| | | | |
|---|---|---|---|
| 2,439,491 | 4/1948 | Schiffl | 204/277 |
| 4,224,131 | 9/1980 | Acero et al. | 204/278 X |
| 4,592,819 | 6/1986 | Suzuki et al. . | |
| 4,668,353 | 5/1987 | Smith et al. . | |
| 4,714,010 | 12/1987 | Smart . | |
| 5,149,411 | 9/1992 | Castle | 204/277 X |
| 5,338,248 | 8/1994 | Sumrack . | |
| 5,470,445 | 11/1995 | Murray et al. . | |

*Primary Examiner*—Donald R. Valentine
*Attorney, Agent, or Firm*—Mark Kusner

[57] ABSTRACT

An electrowinning cell comprised of a tank; an electrolytic solution within the tank defining a solution surface at a predetermined level within the tank; a plurality of flat metallic electrode plates, each of the plates having a support beam along an edge thereof; a support assembly disposed outside the tank for supporting a plurality of the electrodes by the support beams, the support assembly dimensioned to position the electrodes in side-by-side, spaced apart, parallel relationship with a lower portion of the electrodes immersed in the electrolytic solution and an upper portion disposed above the solution surface, the upper portions of the electrodes and the solution surface forming parallel channels extending from one side of the tank to a second side of the tank; a plurality of apertures formed in the tank wall along the one side of the tank, the apertures being disposed above the solution surface and positioned wherein at least one of the plurality of apertures is located between an adjacent pair of the electrodes; a blower and manifold assembly connected to the plurality of apertures for creating gas flow through the plurality of apertures, the blower and manifold assembly dimensioned to create a stream of gas through the channels across the solution surface; an elongated slot formed in the tank wall along the second side of the tank, the slot disposed above the solution surface; and an exhaust blower and manifold assembly for creating a suction through the slot to create a drop in gas pressure opposite the apertures.

13 Claims, 8 Drawing Sheets

VENTILATION SYSTEM FOR ELECTROLYTIC CELL

FIELD OF THE INVENTION

The present invention relates generally to ventilation systems, and more particularly to a ventilation system for an electrolytic cell for electrowinning copper.

BACKGROUND OF THE INVENTION

It is well known that an exceptionally pure form of copper can be extracted from copper dissolved in a sulfuric acid solution through an electrowinning process. An electrowinning process utilizes the known technique of plating metal out of an electrolytic solution onto a cathode.

Modern electrowinning typically occurs in large non-conductive tanks containing copper sulphate dissolved in sulfuric acid solution. A plurality of side-by-side, parallel cathode and anode plates are suspended in the sulfuric acid solution, wherein a portion of the plates extends above the upper surface of the acid solution. The cathodes and anodes are alternately arranged such that each cathode is disposed between two anodes. The anodes and cathodes are connected to a sufficient electrical power source to cause the electroplating to occur. It is well known to use such a process to form either copper plate or copper powder based upon the concentration of copper in solution and the current densities applied to the plates.

During the electrodeposition process, oxygen is liberated at the surface of the anode plates. The gas forms tiny bubbles which rise to the top of the acid solution. At the upper surface of the acid solution, these gas bubbles burst and create an acid mist above the tank. This acid mist represents not only a health hazard to the workers in the area, but also creates a corrosive environment for the electrical equipment and connections necessary to electrically energize the plates, as well as for the overhead mechanical equipment required for inserting and removing the cathodes to retrieve the plated copper. In this respect, because of the structural material required for inserting and removing the cathode plates, conventional overhead ventilation hoods are not practical for removing the acid mist. In this respect, any type of cover which interferes with access to the cells for removing or replacing the cathodes is not desirable.

It has been known to use large massive ventilation systems to remove and circulate air through the building structure, conventionally referred to as tank houses, in which such electrowinning cells are located. As will be appreciated, to remove and circulate sufficient air to meet environmental standards requires extremely massive and expensive ventilation systems. Even then, workers within the tank houses are still exposed to the acid mist, albeit at lower levels, and such systems do not prevent the mist from settling onto surfaces within the structure before they can be removed from the facility. In this respect, such ventilation systems do not really solve the acid mist problem, but merely reduce its levels within a facility.

It has also been known to suppress the mist using foam or floating coalescing balls which float upon the surface of the acid bath. The foam and floating balls theoretically prevent the air bubbles from bursting when they reach the surface of the acid bath, thereby reducing the mist generated by the tank. While such systems do reduce the acid mist, they do not completely eliminate the problem, and present problems in themselves. In this respect, when forming copper powder, copper particulate formed within the tank has a tendency to adhere to the foam and coalescing balls, forming possible short circuits between the adjacent anode and cathode plates. Further, the collection of the gaseous mist within the foam and balls creates potential for gas explosions.

It is thus desirable to provide a method of ventilating an electrolysis tank which overcomes the foregoing drawbacks, yet eliminates the environmental and corrosive hazard of the acid mist without undue expense, and without interfering with the operations of the tank.

The present invention thus provides a ventilation system for an electrolysis cell which suppresses and removes acid mist at the surface of the tank without obstructing access to the tank and without the use of foams or coalescing balls.

In addition, no impurities or foreign objects are added to the acidic solution.

SUMMARY OF THE INVENTION

In accordance with the present invention, there is provided a ventilation system for an electrowinning cell having a tank containing an electrolytic solution and a plurality of parallel electrode plates partially immersed in the solution. The ventilation system is comprised of a first duct extending along a first side of the tank and a blower fan for forcing air into the first duct. A plurality of spaced apart apertures is formed in the duct. The apertures are aligned above and are directed across the surface of the electrolytic solution. Each adjacent aperture has an electrode plate disposed therebetween, wherein each of the apertures directs a stream of air along the surface of the electrolytic solution and the side of at least one electrode plate. A second duct extending along a second side of the tank is provided and is parallel to the first duct. An elongated slot extends along the second duct. The slot faces the apertures and is parallel to the surface of the electrolytic solution and is a predetermined distance thereabove. An exhaust fan is provided for creating a suction in the second duct to draw air through the slot.

In accordance with another aspect of the present invention, there is provided an electrowinning cell comprised of a tank having an electrolytic solution thereon at a predetermined level within the tank. A plurality of flat metallic electrode plates is provided. Each of the plates has a support beam along an edge thereof. A support assembly is disposed outside the tank for supporting a plurality of the electrodes on the support beams. The support assembly is dimensioned to position the electrodes in side-by-side, spaced apart, parallel relationship with a lower portion of the electrodes immersed in the electrolytic solution and an upper portion disposed above the solution surface. The upper portions of the electrodes and the solution surface form parallel channels extending from one side of the tank to a second side of the tank. A plurality of apertures is formed in the tank wall along one side of the tank. The apertures are disposed above the solution surface and are positioned wherein at least one of the plurality of apertures is located between an adjacent pair of the electrodes. A blower and manifold assembly is connected to the plurality of apertures for creating gas flow through the plurality of apertures. The blower and manifold assembly are dimensioned to create a stream of gas through the channels across the solution surface. An elongated slot is formed in the tank wall along the second side of the tank. The slot is disposed above the solution surface. An exhaust blower and manifold assembly is provided to create a suction through the slot to create a drop in gas pressure opposite the apertures.

It is an object of the present invention to provide a ventilation system for removal of gases and mists from an electroplating cell.

Another object of the present invention is to provide a ventilation system as described above for removal of gases and mists from a parallel plate electrolytic cell which system provides improved mist suppression and removal over systems known heretofore.

A still further object of the present invention is to provide a ventilation system as described above which does not obstruct access to the electrolytic cell.

A still further object of the present invention is to provide a ventilation system as described above which does not require surfactants, coalescing balls or any other material on the surface of the electrolytic solution.

A still further object of the present invention is to provide a ventilation system as described above which does not introduce foreign materials or objects into the electrolytic solution.

A still further object of the present invention is to provide a ventilation system as described above which is less costly and more efficient than ventilation systems known heretofore.

These and other objects and advantages will become apparent from the following description of a preferred embodiment of the invention taken together with the accompanying drawings.

BRIEF DESCRIPTION OF THE DRAWINGS

The invention may take form in certain parts and arrangement of parts, preferred embodiments of which will be described in detail in the specification and illustrated in the accompanying drawings wherein.

DETAILED DESCRIPTION OF PREFERRED EMBODIMENT

Figure 1:
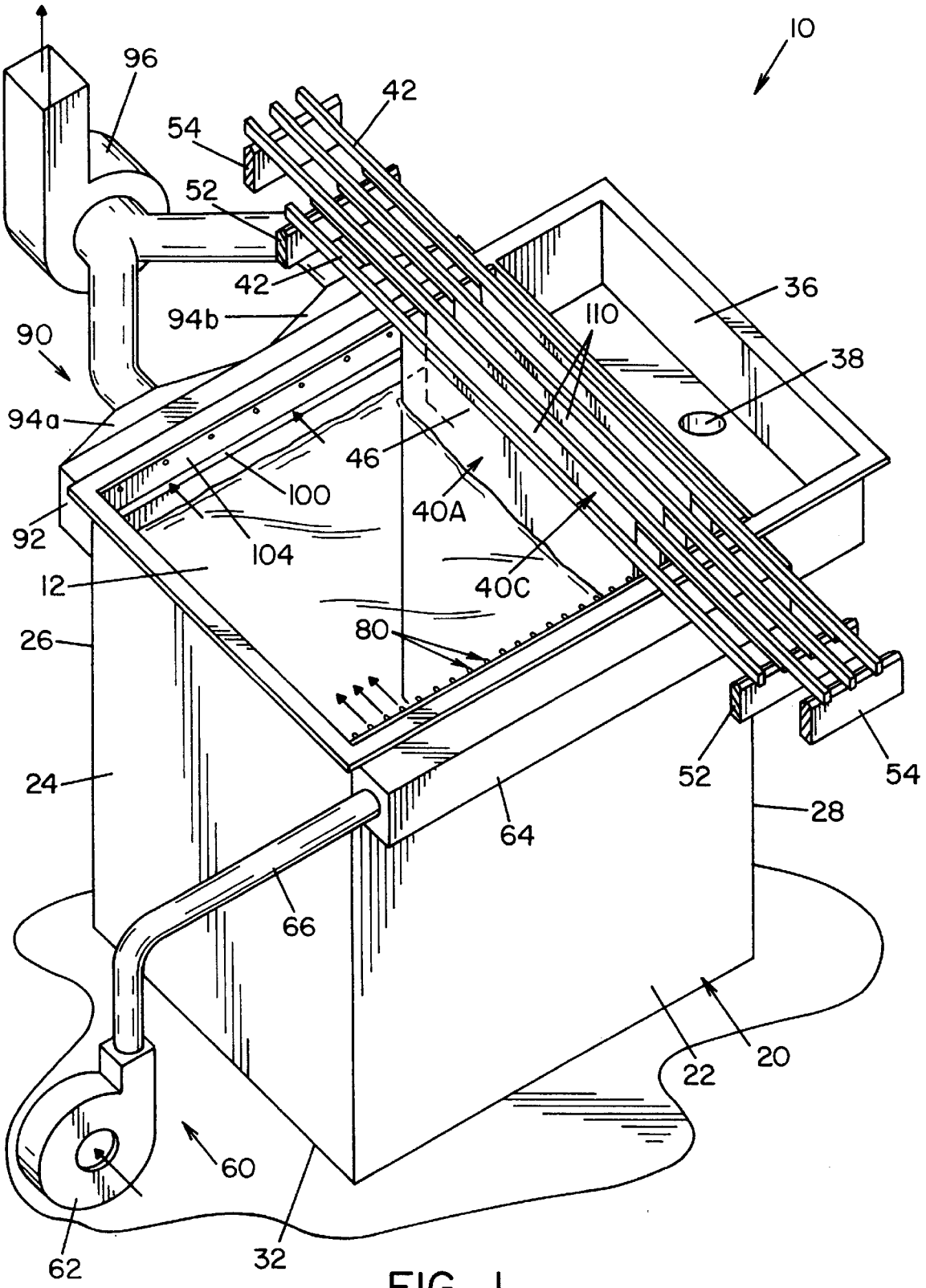
FIG. 1 is a perspective view of an electrowinning cell having parallel electrodes therein, and having a ventilation system according to a preferred embodiment of the present invention.

Referring now to the drawings wherein the showing is for the purpose of illustrating a preferred embodiment of the invention only, and not for the purpose of limiting same, FIG. 1 is a perspective view of an electrowinning cell 10 for producing extracting metal from an electrolytic solution containing the metal.

The present invention will be described with respect to an electrowinning cell producing copper, although it will be appreciated that such cell may be also used for forming other metals, such as zinc.

Figure 2:
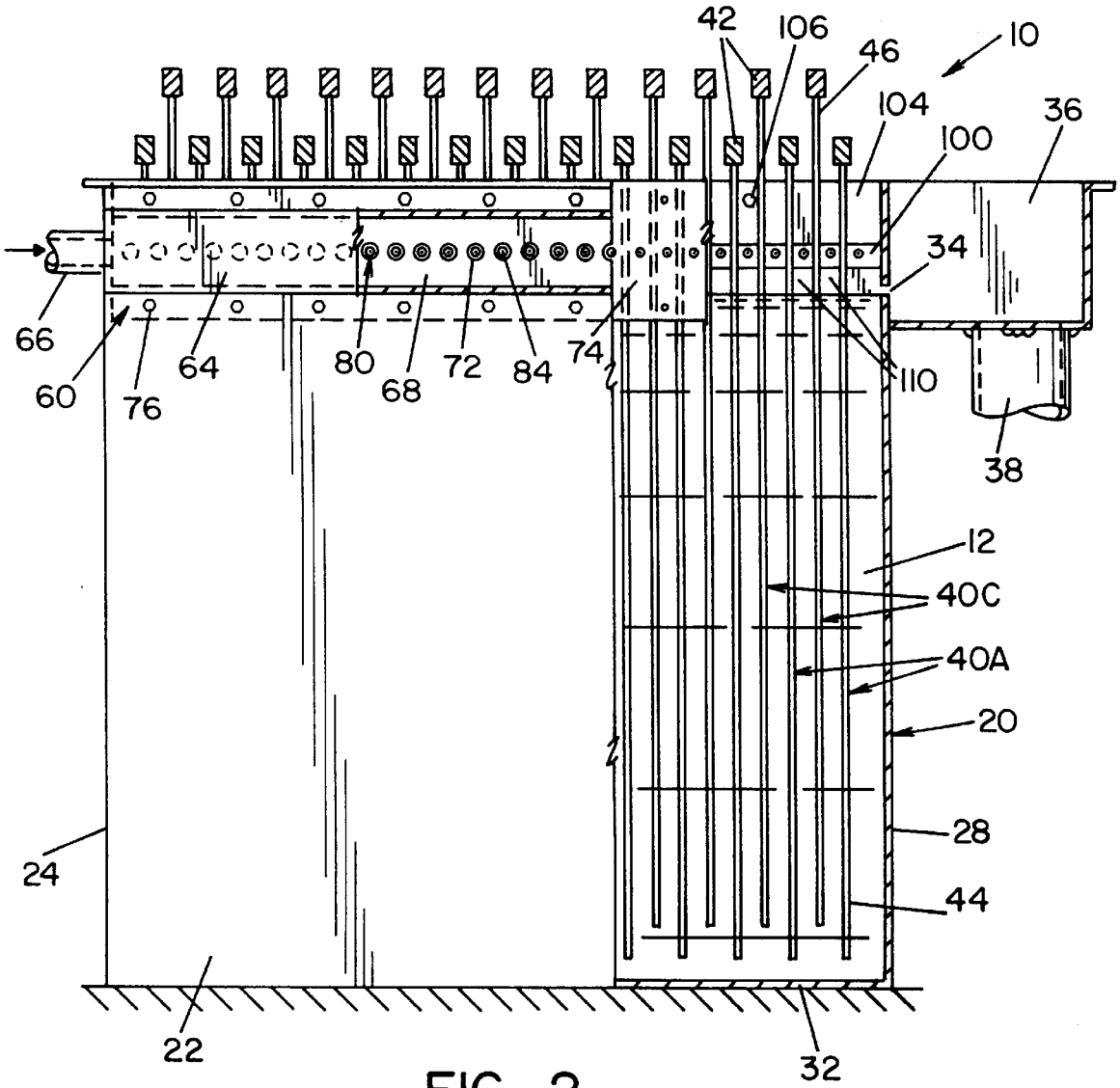
FIG. 2 is a partially sectioned, elevational view showing the electrowinning cell shown in FIG. 1.
Figure 3:
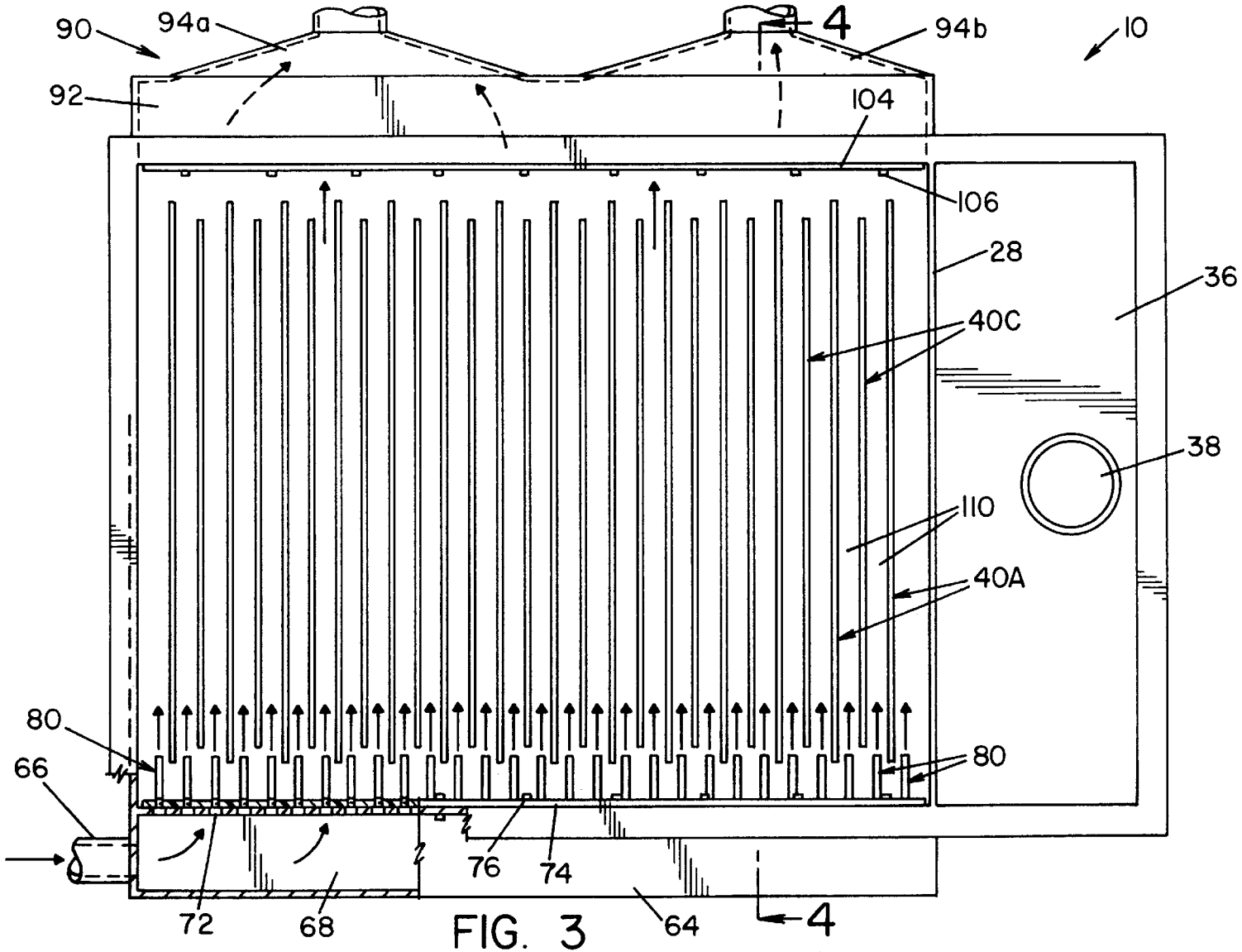
FIG. 3 is a top plan view of the cell shown in FIG. 1.

Broadly stated, cell 10 is comprised of a tank 20 containing an electrolytic solution 12. In the embodiment shown, tank 20 is generally rectangular in shape and includes vertical side walls 22, 24, 26, 28 and a bottom wall 32. Side wall 28 has an opening 34 formed therein to define a weir to establish a predetermined level for electrolytic solution 12 contained within tank 20. A trough 36 best illustrated in FIGS. 1 and 2 is formed along side wall 28 to collect electrolytic solution flowing through opening 34. Trough 36 has a drain 38 formed in the bottom thereof to remove electrolytic solution collected therein. Tanks of electrodepositing cells of this type are typically formed of a corrosion-resistant and acid-resistant material, such as plastic or inert metal, and drains and solution feed lines are typically provided on the tank to facilitate recirculation, replenishment and cooling of the electrolytic solution. Such drains and recirculation systems in and of themselves form no part of the present invention, and therefore, are not shown in the drawings.

Figure 4:
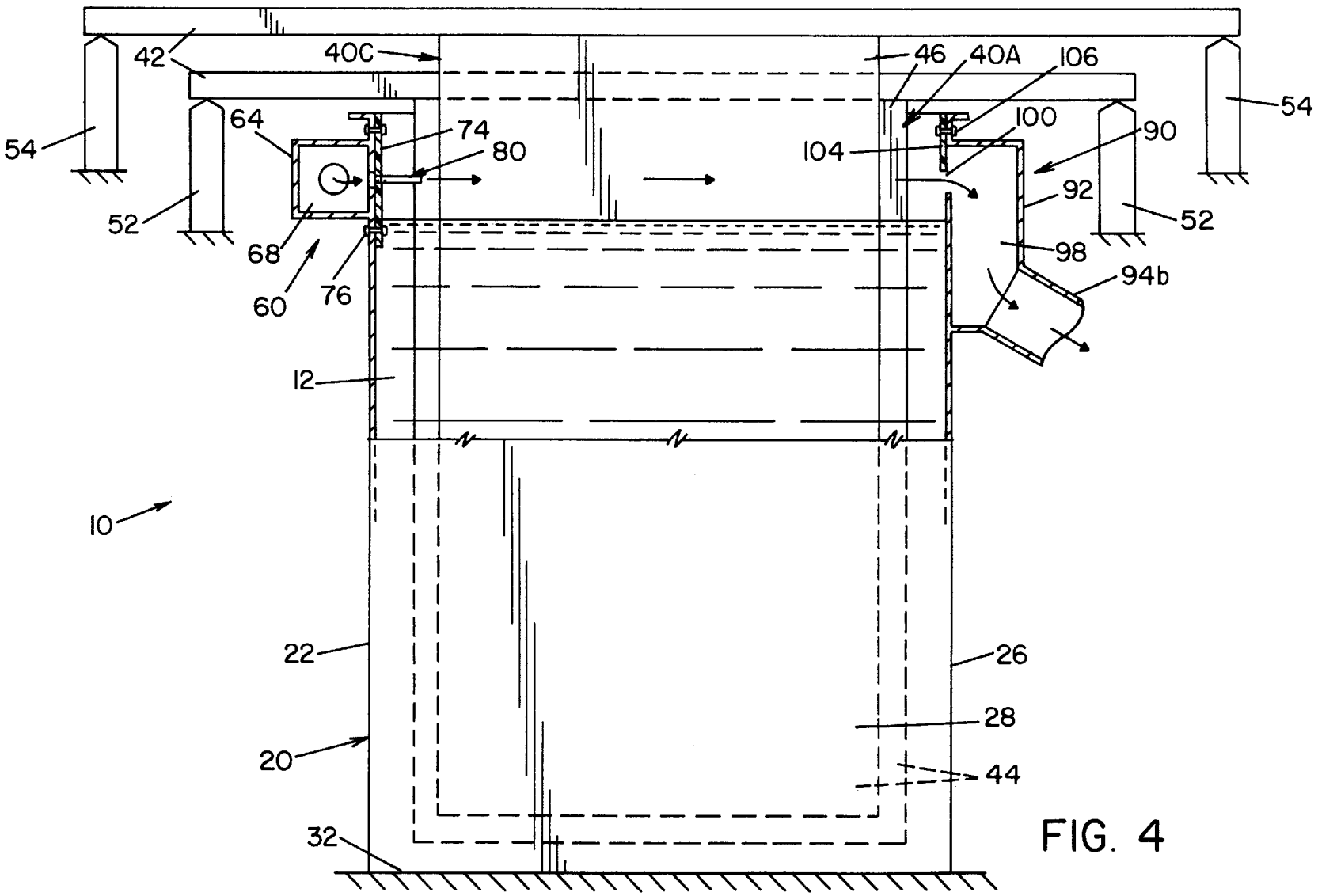
FIG. 4 is a sectional view taken along lines 4—4 of FIG. 3.

Tank 20 is dimensioned to receive a plurality of side-by-side, parallel electrodes 40. Electrodes 40 are generally flat plates adapted to be supported within tank 20 in side-by-side, spaced apart relationship. In the embodiment shown, electrodes 40 are rectangular in shape, and are held in place by beams 42 which are secured to the upper edge of electrodes 40. Beams 42 are dimensioned to extend across tank 20 and to be supported by supports 52, 54, which are schematically illustrated in FIGS. 1 and 4. Electrodes 40 are individually connected to electrical power sources (by means not shown) to create anodes and cathodes. Electrodes 40 are electrically energized such that electrodes 40 alternate between cathode and anode. In the embodiment shown, the anode plates are slightly longer in length (i.e., in length across tank 20 from tank wall 22 to tank wall 26) than the cathode plate. In the drawings, electrodes 40 which are charged as anodes are designated 40A and electrodes 40 charged as cathodes are designated 40C.

Structural supports 52, 54 are disposed outside tank 20 to support beams 42 with electrodes 40A and 40C suspended within tank 20. Supports 52, 54 are dimensioned such that a lower portion 44 of each electrode 40 is disposed within the tank and it is immersed within the electrolytic solution contained therein. Because beams 42 span across the upper edge of the tank, an upper portion 46 of each electrode 40 is disposed above the surface of the electrolytic solution.

Figure 5:
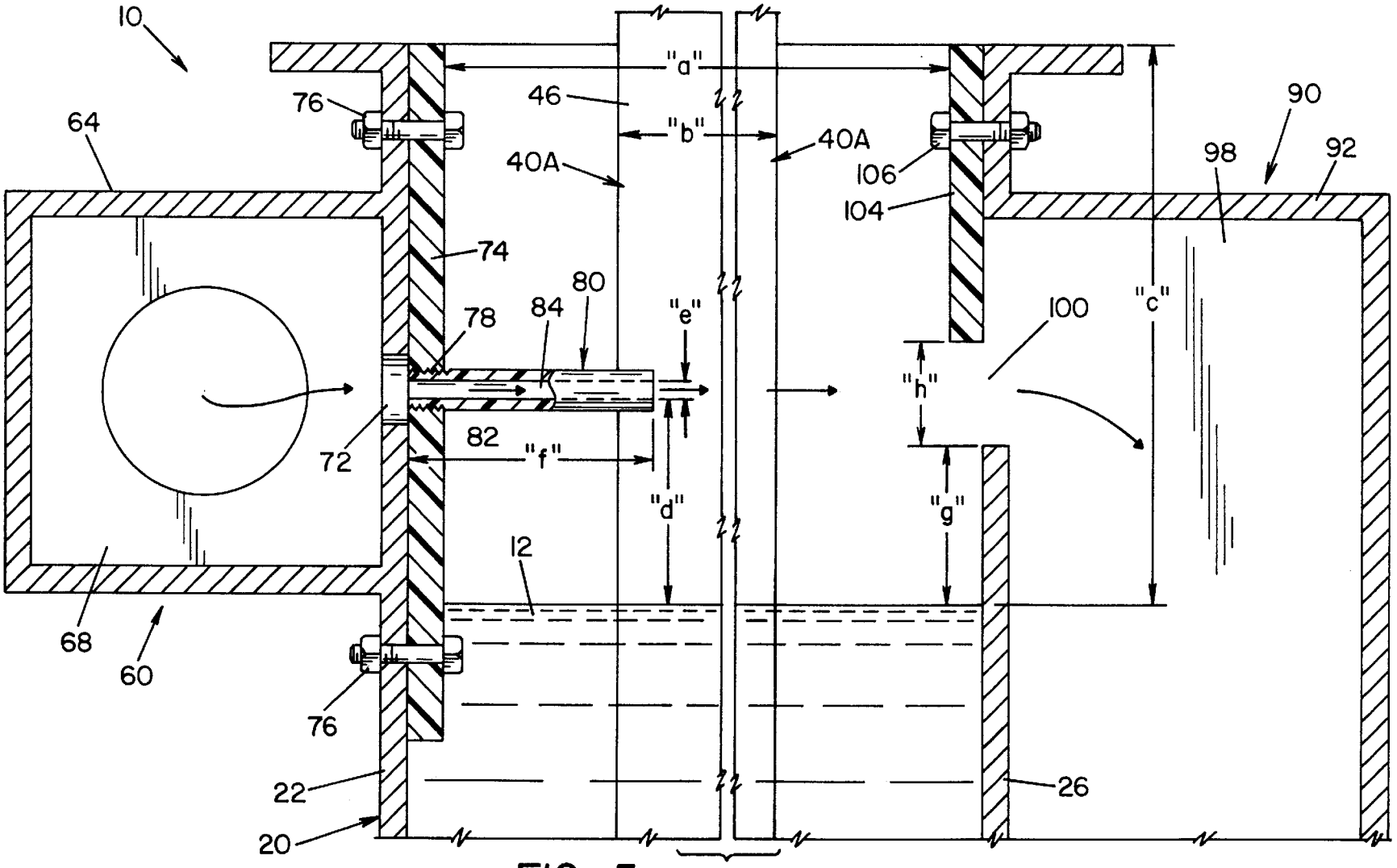
FIG. 5 is an enlarged, sectional view of the "push/pull" ventilation system according to the present invention.

According to the present invention, a ventilation system is provided with cell 10 to collect the mist and vapors generated by the electrowinning process. In the embodiment shown, the ventilation system is comprised of a blower assembly 60 disposed along the upper edge of tank wall 22 and an exhaust assembly 90 disposed along the upper edge of tank wall 26. Blower assembly 60 is comprised of a blower fan 62, schematically illustrated in FIG. 1, and a first duct 64 extending along the upper edge of tank wall 22. In the embodiment shown, duct 64 is generally rectangular in shape and has an inlet pipe 66 connecting duct 64 to blower fan 62. Duct 64 defines an internal chamber 68, best seen in FIG. 5, in communication with the internal passage defined through pipe 66. As best seen in FIG. 5, in the embodiment shown a portion of duct 64 is defined by tank wall 22.

A plurality of apertures 72 are provided in tank wall 22 to communicate the inner chamber 68 with the inside of tank 20. Apertures 72 are aligned along the upper edge of tank wall 22 and are disposed a predetermined distance above the upper surface of the electrolytic solution. A flat plate 74 is attached to tank wall 22 by conventional fasteners 76. Plate 74 is fastened to tank wall 22 in fluid-tight fashion. Plate 74 is provided with a plurality of threaded openings 78 disposed to be registry with the apertures 72 in tank wall 22. Threaded openings 78 are dimensioned to receive a tubular nozzle 80 which has a threaded end 82. Tubular nozzle 80 defines an inner passageway 84 which is in communication (through aperture 72 in tank wall 22) with internal chamber 68 of duct 64. Nozzle 80 is dimensioned such that the free end thereof extends near the plane of the edges of the electrodes 40A.

Referring now to FIGS. 4 and 5, exhaust assembly 90 is best shown. Exhaust assembly 90 is generally comprised of a rectangular duct 92 formed along the upper edge of tank wall 26. Duct 92 is disposed to be opposite duct 64. In the embodiment shown, duct 92 includes two branch ducts 94*a*, 94*b* which are connected to an exhaust blower 96, that is schematically shown in FIG. 1. Duct 92 defines an inner plenum 98 in communication with passages defined in branch ducts 94*a*, 94*b*. As seen in FIG. 5, in the embodiment shown, a portion of duct 92 is defined by tank wall 26. A slot 100 is defined in tank wall 26 such that plenum 98 is in communication with the inside of tank 20. Slot 100 is disposed a predetermined distance above the surface of the electrolytic solution. In this respect, slot 100 extends generally parallel to the surface of the electrolytic solution, and is disposed at approximately the same elevation as nozzles 80. A rectangular plate 104 is attached to tank wall 26 by conventional threaded fasteners. Plate 104 is operable to reduce the size of the opening defined by slot 100.

Blower assembly 60 and exhaust assembly 90 are dimensioned to provide a push-pull type ventilation system across the surface of the electrolytic solution to suppress and collect mist and fumes generated by cell 10.

Figure 6:
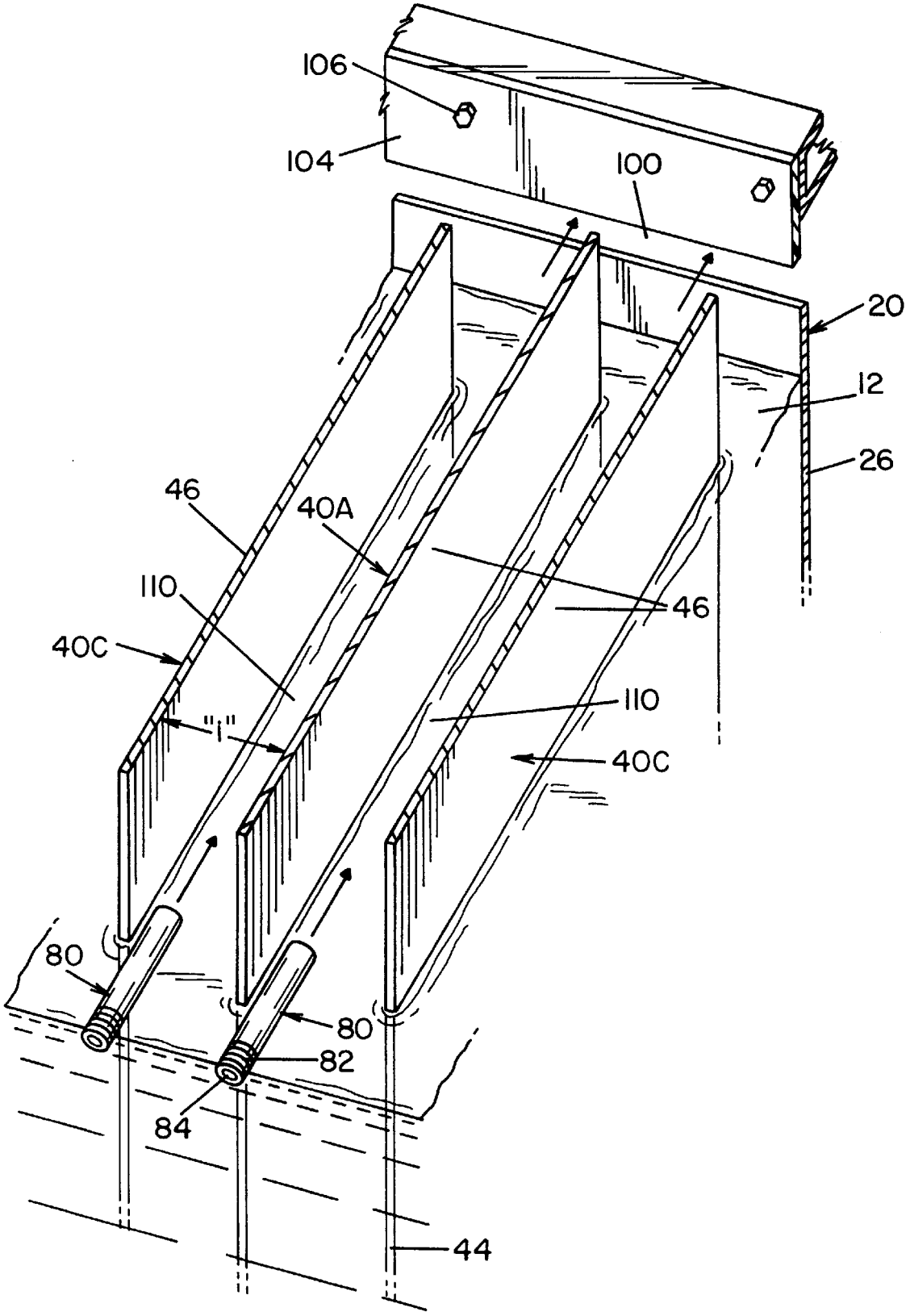
FIG. 6 is an enlarged, perspective view of a portion of the electrowinning cell shown in FIG. 1, illustrating the position and configuration of the push/pull ventilation system relative to the anode/cathode plates and acid solution.

Referring now to the operation of the ventilation system, reference is made to FIG. 6 which is a perspective view of a portion of cell 10 showing the positions of nozzles 80 and slot 100 relative to anode and cathode plates 40A and 40C. As illustrated in FIG. 6, nozzles 80 are disposed and extended along an axis that is equidistant between adjacent plates 40A and 40C. Upper portion 44 of anode and cathode plates 40A, 40C and the surface of the electrolytic solution define parallel passages or channels 110 extending across the surface of the electrolytic tank. Blower fan 62 is dimensioned to create a predetermined flow of air through each nozzle 80. In this respect, a stream of air is directed across the surface of the electrolytic solution between upper portions 44 of adjacent electrodes 40A, 40C. Exhaust blower 96 is dimensioned to produce a predetermined flow of air through slot 100. In this respect, exhaust blower 100 is dimensioned to create a greater flow of air through slot 100 than the total flow of air through nozzles 80. When nozzles 80 create a jet of air through channels 110, a "Venturi" effect is created along the surface of the electrolytic solution. The fast moving stream of air created by nozzles 80 along the surface of the electrolytic solution has a lower pressure than air further away from the surface of the electrolytic solution. In other words, the initially stationary air above the upper edges of electrodes 40 is at a higher pressure than the air moving across the electrolytic solution. This creates a pressure differential that forces air above the cell downward toward the surface of the electrolytic solution where it is entrained in the stream of air being jetted by nozzles 80 across the surface of the electrolytic solution and captured by downward moving air acting under the influence of slot 100 by exhaust fan 96.

Figure 7:
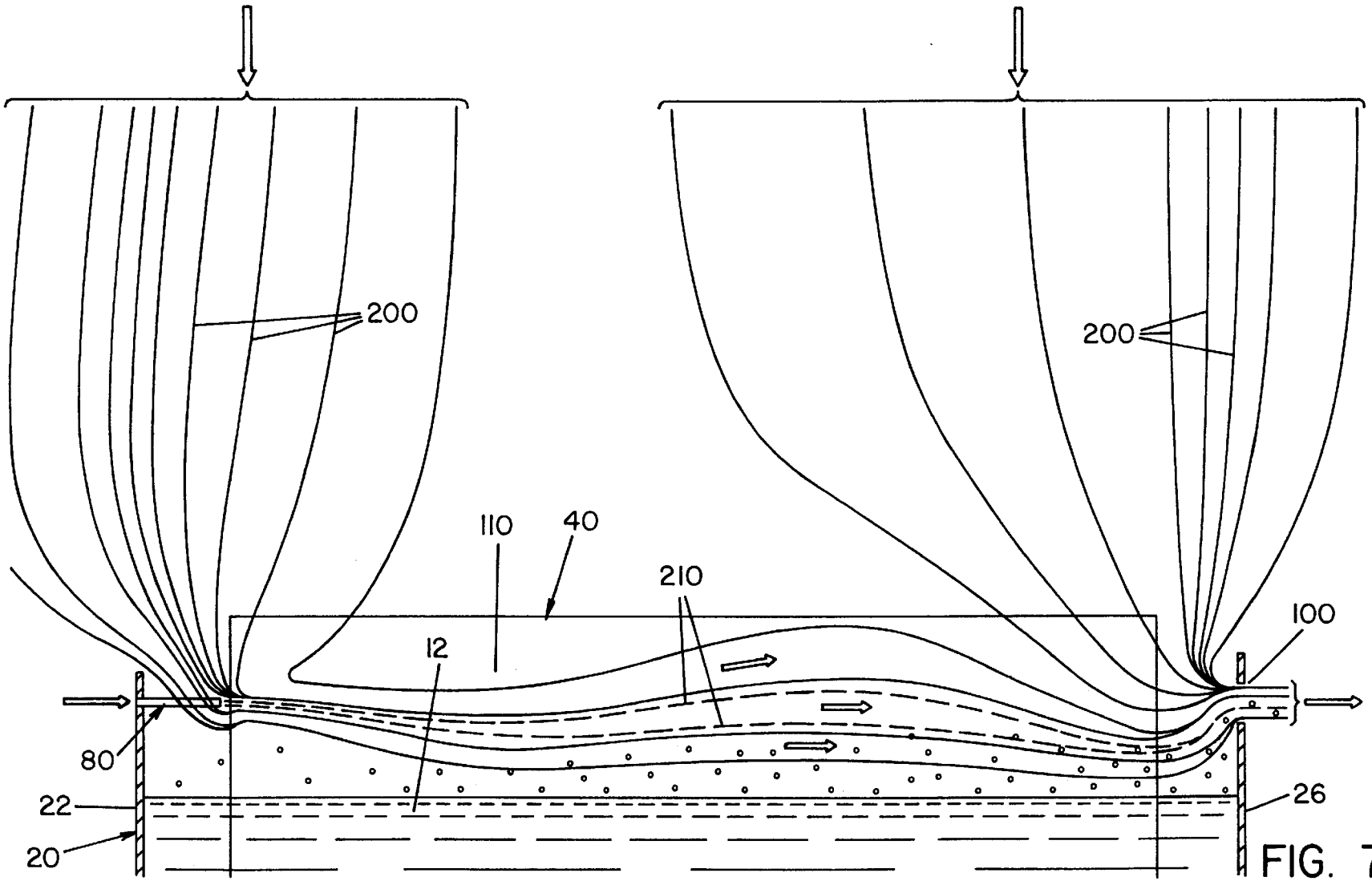
FIG. 7 is a computer-generated representative showing of the air flow pattern created above the surface of the acid solution by the push/pull ventilation system of the present invention.

FIG. 7 is a computer-generated air flow profile for the ventilation system heretofore described. In FIG. 7, solid lines 200 represent ambient air, whereas broken lines 210 represent air provided by blower assembly 60. FIG. 7 illustrates how air jetted out of a nozzle 80 moves across the surface of the electrolytic solution and is collected within slot 100. In this respect, the air jet created across the surface of the electrolytic solution decrease the pressure at this location causing the air above the upper edge of electrodes 40 (i.e., above the cell), which air is at a higher pressure to be drawn down into the stream of air as a result of the pressure differential existing at the surface of the electrolytic solution and at locations above the cell. This downward movement of air from the area above the cell basically forces mist and fumes illustrated as bubbles in FIG. 7 from leaving the regions of the tank, and allows exhaust fan 96 to collect same. In the context of the present invention, it is believed that the parallel electrodes 40A, 40C also form an important part in the operation of the present invention in that the confined channels 110 defined by adjacent electrodes create a restrictive path for air flow and thereby assist in creating the downward draft illustrated in FIG. 7.

A computer model simulation of the operation of the foregoing assembly is conducted. The computer simulation is based upon a tank and ventilation structure having the following dimensions that are best understood with reference to FIG. 5.

| | | |
|---|---|---|
| "a" (width of tank) | = | 39 inches |
| "b" (length of anode) | = | 33 inches |
| "c" (height of tank wall above surface of solution) | = | 6 inches |
| "d" (height of nozzle 80 above surface of solution) | = | 3 inches |
| "e" (nozzle inner diameter) | = | .25 inch |
| "f" (length of nozzle 80) | = | 3 inches |
| "g" (height of slot 100 above surface of solution) | = | 2.25 inches |
| "h" (height of slot 100) | = | 1.5 inches |
| "i" (spacing between adjacent electrodes) | = | 1.25 inches |

For the prototype electrowinning cell, the following boundary conditions are assumed:

Acid mist release rate=1600 mg/min per full cell

Electrolytic surface temperature=120° F.

Building ambient temperature=60° F.

For the purpose of the computer simulation, the operation and effects of the ventilation system along a single channel 110 are evaluated, the assumption being that like characteristics and results would be exhibited by other channels 110.

Based upon the computer simulation, it is found that the velocity of air ($V_O$) at the nozzle as well as the air flow ($Q_O$) through slot 100 are important to the operation of the ventilation system. In this respect, the jet $Q_OV_O$ parameter (flow rate multiplied by velocity) is a determining factor in the performance of this ventilation system. It is found that a particular range of push jet $Q_OV_O$ values yields optimum performance based upon the given structural dimensions. In this respect, if the $Q_OV_O$ parameter is too high, then the push jet will entrain too much ambient air which causes the exhaust assembly to be "overloaded" by the push jet due to the fixed capacity of the exhaust system. If the jet $Q_OV_O$ parameter is too low, the rising acid mist will push through the weak air curtain. Further, a high jet flow rate ($V_O$) creates greater turbulence between the electrodes 40 which results in greater acid mist dispersion above electrodes 40. With respect to the position of nozzle 80, if the push jet nozzle 80 is positioned too close to the electrolytic surface, it is likely to increase turbulence along the surface of the electrolytic solution and will further increase dispersion of acid mist. Conversely, if nozzle 80 is positioned too high, buoyancy created by the heated acid below the jet of air will amplify the characteristic "bubble" in the flow stream and "lift" more acid mist above the electrode plates. Thus, the position of nozzle 80 as well as the flow rate of air through nozzle 80 are critical. According to the present invention, the position of nozzle 80 and the flow rate thereto are preferably selected wherein a smooth jet of air is created through channel 110 without causing turbulence along the surface of the electrolytic solution, and wherein the flow rate of air from nozzle 80 will entrain ambient air into the jet flow. Similarly, the flow rate through slot 100 is selected to be able to remove the air jetted from nozzle 80 together with the ambient air entrained and collected by the flow of air from nozzle 80 as it moves through channel 110.

For the test model as described above, computer simulations indicated that for a 3-inch long nozzle 80 having a 0.25-inch inner diameter, having a jet velocity ($V_O$) of 3100 feet per minute (fpm) and a flow rate ($Q_O$) of 1 cubic feet per minute (cfm) at slot 100, produces a $Q_O V_O$ value of 31,165 $ft^4/min^2$ per foot of cell. Under these operating conditions, the computer simulation indicates that 100% of the mist generated by cell 10 is captured by the ventilation system.

Figure 8:
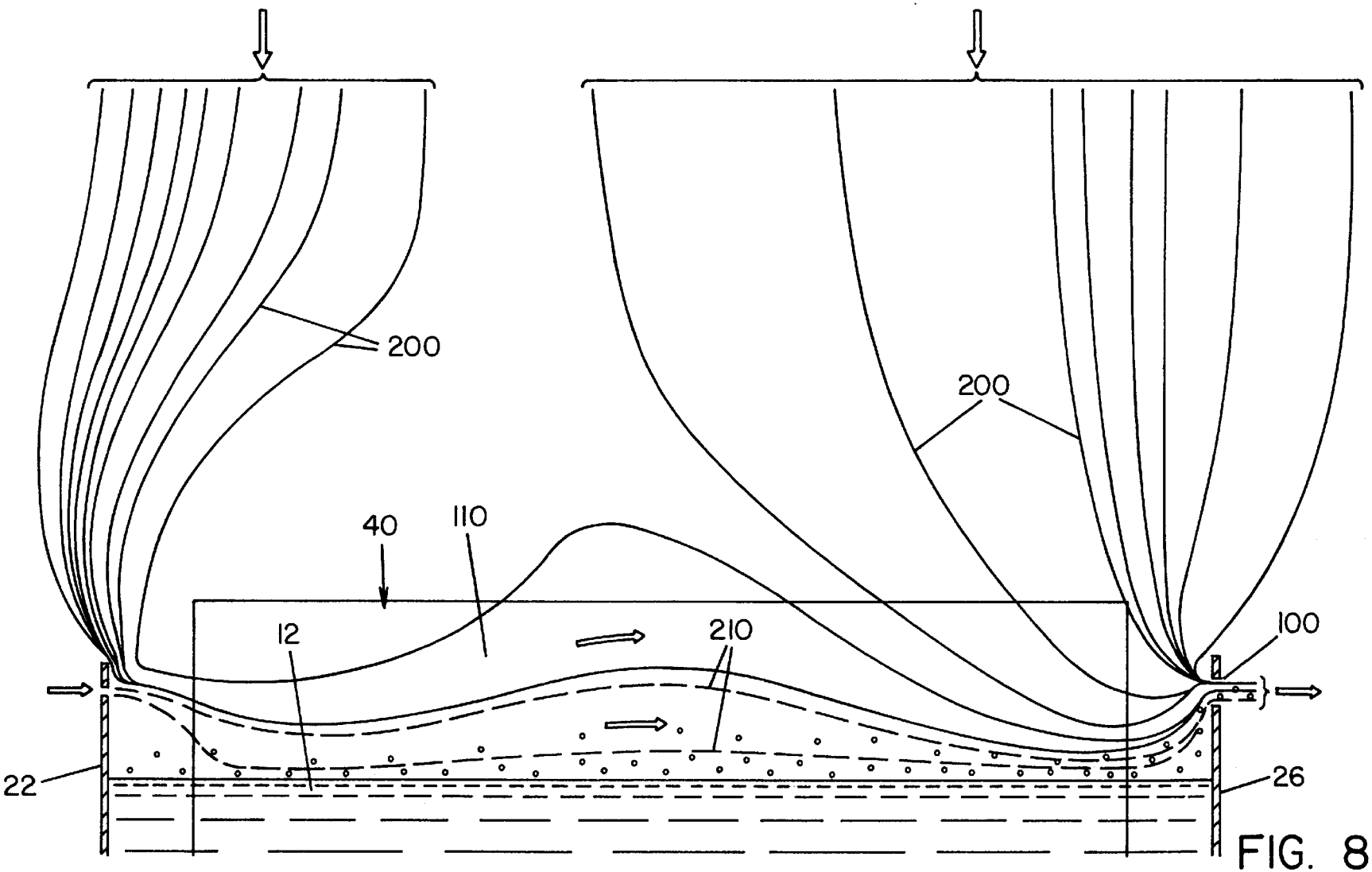
FIG. 8 is a computer-generated representative showing of the air flow pattern created above the surface of the acid solution by an alternate embodiment of the present invention.

Referring now to FIG. 8, an alternate embodiment of the present invention is shown. FIG. 8 is a computer-generated air flow profile for a ventilation system of the type and size as previously described, but where nozzles 80 are not used on the push side of the ventilation system. In place of nozzles 80, a 0.25-inch diameter apertures are provided in tank wall 22. FIG. 8 illustrates the computer-generated air flow profile for such an arrangement when the same operating conditions as previously described are created. As seen in FIG. 8, air flow from the push side to the pull side of the ventilation system still entrains air from above the cell creating a downward movement of air as the result of a low pressure created by the jet of air. As with the prior configuration using nozzles 80, air from above the cell is forced downward toward the surface of the electrolytic solution, thereby entraining mist and vapors from the electrolytic cell into the exhaust slot.

The present invention thus provides a ventilation system for an electrowinning cell which is both highly efficient in confining and removing mist and vapors from the surface of the electrolytic cell, and at the same time, provides a ventilation system which does not obstruct overhead use of the cell.

The foregoing description is a specific embodiment of the present invention. It should be appreciated that this embodiment is described for purposes of illustration only, and that numerous alterations and modifications may be practiced by those skilled in the art without departing from the spirit and scope of the invention. It is intended that all such modifications and alterations be included insofar as they come within the scope of the invention as claimed or the equivalents thereof.

Having described the invention, the following is claimed:

1. A ventilation system for an electrowinning cell having a tank adapted to contain an electrolytic solution and to receive a plurality of parallel electrode plates partially immersed in said solution, said ventilation system, comprised of:

a first duct extending along one side of said tank perpendicular to a plurality of parallel electrode plates when said electrode plates are present;

a blower fan for forcing air into said first duct;

a plurality of spaced apart apertures formed in said duct, said apertures adapted to face said electrolytic solution when said electrolytic solution is present, adjacent apertures positioned to have an electrode plate disposed therebetween when said plates are present, wherein said apertures are positioned to direct a stream of air along each surface of said electrode plates;

a second duct extending along a side of said tank parallel to said first duct;

an elongated slot extending along said second duct, said slot facing said apertures and being in parallel alignment with said apertures; and an exhaust fan for creating a suction in said second duct to draw air through said slot.

2. A ventilation system as described in claim 1, wherein said duct includes nozzles extending therefrom, said nozzles forming said apertures.

3. An electrowinning cell, comprised of:

a tank;

a weir arrangement in said tank defining an electrolytic solution operating level when electrolytic solution is present within said tank;

a plurality of flat metallic electrode plates, each of said plates having a support beam along an edge thereof;

a support assembly disposed outside said tank for supporting a plurality of said electrodes by said support beams, said support assembly dimensioned to position said electrodes in said tank in side-by-side, spaced apart, parallel relationship with a lower portion of said electrodes below said electrolytic solution operating level and an upper portion disposed above said electrolytic solution operating level, the upper portions of said electrodes and the electrolytic solution operating level forming parallel channels extending from one side of said tank to a second side of said tank;

a plurality of apertures formed in said tank wall along said one side of said tank, said apertures disposed above said electrolytic solution operating level and disposed wherein at least one of said plurality of apertures is located between an adjacent pair of said electrodes;

a blower and manifold assembly connected to said plurality of apertures for creating gas flow through said plurality of apertures, said blower and manifold assembly dimensioned to create a stream of gas through said channels above said electrolytic solution operating level;

an elongated slot formed in said tank wall along said second side of said tank, said slot disposed above the electrolytic solution operating level; and an exhaust blower and manifold assembly for creating a suction through said slot to create a drop in gas pressure opposite said apertures.

4. A cell as defined in claim 3, wherein said apertures are aligned along an axis parallel to said electrolytic solution operating level, and said slot extends parallel to said electrolytic solution operating level.

5. A cell as defined in claim 3, wherein the dimensions of said slot are adjustable to vary the opening defined thereby.

6. A cell as defined in claim 3, wherein said blower and manifold assembly comprises a first duct formed along said one side of said tank, said first duct having an internal chamber in communication with said plurality of apertures, and a blower fan communicating with said internal chamber in said first duct.

7. A cell as defined in claim 6, wherein said exhaust and manifold assembly comprises a second duct formed along said second side of said tank, said second duct having an internal chamber in communication with said slot, and at least one exhaust fan communicating with said internal chamber of said second duct.

8. A cell as defined in claim 3, wherein a plurality of tubular members having internal passages extending into said tank from said one side of said tank, said internal passages defining said apertures.

9. An electrowinning cell assembly, comprised of:

a tank for holding an electrolytic solution;

a weir arrangement in said tank for establishing an operating level for said electrolytic solution;

a support structure for supporting a plurality of flat, planar metallic electrode plates in said tank such that a major portion of each of said electrode plates is below said operating level;

a first duct extending along an edge for said tank perpendicular to said electrode plates;

a blower for forcing air into said first duct;

a plurality of spaced apart apertures formed in said first duct, said apertures disposed above said operating level to direct a stream of air across said tank along each surface of each of said electrode plates;

a second duct extending along a side of said tank parallel to said first duct, said second duct having a slot above said operating level in registry with said aperture in said first duct;

an exhaust fan for creating a suction in said second duct to draw air through said slot.

10. An assembly as defined in claim 9, wherein said blower and exhaust fan operate to produce a turbulent-free air flow across said tank.

11. An assembly as defined in claim 10, wherein said blower and exhaust fan operating to enable the air flow into said second duct through said slot to be greater than said air flow exiting said first duct through said apertures.

12. As assembly as defined in claim 9, wherein said air flow across said tank produces a low pressure above said tank.

13. An assembly as defined in claim 9, wherein said first duct includes a plurality of tubular members dimensioned to extend between said electrode plates, said tubular members defining said apertures.

* * * * *